US006587087B1

(12) United States Patent
Ishizuka

(10) Patent No.: US 6,587,087 B1
(45) Date of Patent: Jul. 1, 2003

(54) CAPACITIVE LIGHT-EMITTING ELEMENT DISPLAY DEVICE AND DRIVING METHOD THEREFOR

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/478,797

(22) Filed: Jan. 7, 2000

(30) Foreign Application Priority Data

Jan. 7, 1999 (JP) ..... 11-002200

(51) Int. Cl.[7] ..... G09G 3/32
(52) U.S. Cl. ..... 345/82; 345/77
(58) Field of Search ..... 345/74.1, 36, 76, 345/77, 55, 82, 83; 315/169.3, 169.4, 169.1, 169.2

(56) References Cited

U.S. PATENT DOCUMENTS 4,864,182 A * 9/1989 Fujioka et al. ..... 315/169.3
5,309,150 A * 5/1994 Ohba et al. ..... 345/76
5,844,368 A * 12/1998 Okuda et al. ..... 315/169.1
5,952,789 A * 9/1999 Stewart et al. ..... 315/169.4
6,008,588 A * 12/1999 Fujii ..... 315/169.3
6,201,520 B1 * 3/2001 Iketsu et al. ..... 315/169.3
6,222,323 B1 * 4/2001 Yamashita et al. ..... 315/169.3

* cited by examiner

*Primary Examiner*—Steven Saras
*Assistant Examiner*—Uchendu O. Anyaso
(74) *Attorney, Agent, or Firm*—Sughrue Mion, PLLC

(57) ABSTRACT

A method of driving a capacitive light-emitting element display device which accomplishes a wide adjustable range for the luminance of a panel and reduced power consumption. The capacitive light-emitting element display device has a plurality of capacitive light-emitting elements arranged at a plurality of intersections of drive lines and scanning lines and connected between the scanning lines and the drive lines. The scanning lines are connected to one of first and second potentials which are different from each other. The drive lines are connected to either the lower potential of the first and second potentials or a drive source. In synchronism with a scanning period in which selected one of the scanning lines is connected to the lower potential of the first and second potentials, selected one of the drive lines is connected to the drive source to force a capacitive light-emitting element associated therewith to emit light, and simultaneously, the scanning lines, not selected, are connected to the lower potential of the first and second potentials. The higher potential of the first and second potentials is made adjustable.

40 Claims, 11 Drawing Sheets

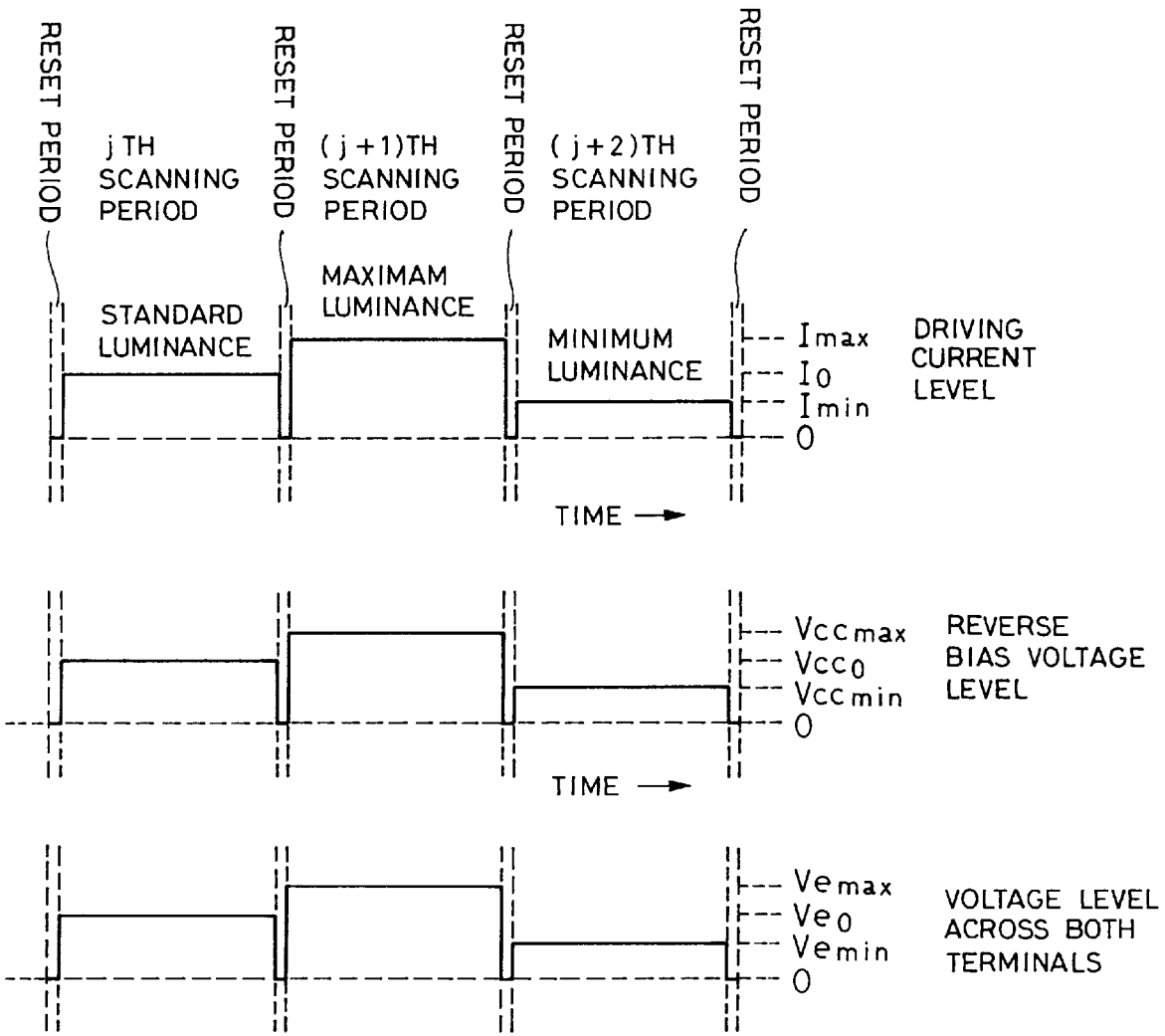
FIG.13A Ax
FIG.13B B NOT SCANNED
FIG.13C LUMINANCE LEVEL L

Ax

B NOT SCANNED

CAPACITIVE LIGHT-EMITTING ELEMENT DISPLAY DEVICE AND DRIVING METHOD THEREFOR

BACKGROUND OF THE INVENTION

1. Field of the Invention

The present invention relates generally to a method and apparatus for driving an image display panel, and more particularly to a method and apparatus for driving a display using capacitive light-emitting elements such as organic electroluminescence elements or the like.

2. Description of Related Art

An electroluminescence display comprised of a plurality of organic electroluminescence elements arranged in a matrix has drawn attention as a display which provides for low power consumption, high display quality, and reduced thickness. As illustrated in FIG. 1, such an organic electroluminescence element has a transparent substrate 100 such as a glass plate on which a transparent electrode 101 is formed; at least one organic functional layer 102 including an electron transport layer, a light emitting layer, a hole transport layer and so on laminated on the transparent electrode 101; and a metal electrode 103 laminated on the organic functional layer 102. The transparent electrode 101 serving as an anode is applied with a plus voltage, while the metal electrode 103 serving as a cathode is applied with a minus voltage, i.e., a direct current is applied across the transparent electrode and the metal electrode, to cause the organic functional layer 102 to emit light. By using an organic compound possibly expected to exhibit satisfactory light emitting characteristics for the organic functional layer, the electroluminescence display has become good enough to be fit for practical use.

The organic electroluminescence element (hereinafter simply called the "element" as well) may be electrically represented as an equivalent circuit as illustrated in FIG. 2. As can be seen from the figure, the element can be replaced with a circuit configuration composed of a capacitive component C and a component E of a diode characteristic coupled in parallel with the capacitive component. Thus, the organic electroluminescence element can be regarded as a capacitive light-emitting element. As the organic electroluminescence element is applied with a direct current light-emission driving voltage across the electrodes, a charge is accumulated in the capacitive element C. Subsequently, when the applied voltage exceeds a barrier voltage or a light emission threshold voltage inherent to the element, a current begins flowing from one electrode (on the anode side of the diode component E) to the organic functional layer which carries the light emitting layer so that light is emitted therefrom at an intensity proportional to this current.

The Voltage V—Current I—Luminance L characteristic of such an element is similar to the characteristic of a diode, as illustrated in FIG. 3. Specifically, the current I is extremely small at a light emission threshold Vth or lower, and abruptly increases as the voltage increases to the light emission threshold Vth or higher. The current is substantially proportional to the luminance. Such an element, when applied with a driving voltage exceeding the light emission threshold Vth, exhibits a light emission luminance in proportion to a current corresponding to the applied driving voltage. On the other hand, the light emission luminance remains equal to zero when the driving voltage applied to the element is at the light emission threshold Vth or lower which does not cause the driving current to flow into the light emitting layer.

As a method of driving a display panel using a plurality of organic electroluminescence elements as described above, a simple matrix driving mode may,be applied. FIG. 4 illustrates the structure of an exemplary simple matrix display panel. As can be seen, n cathode lines (metal electrodes) $B_1$–$B_n$ are arranged extending in parallel in the horizontal direction, and m anode lines (transparent electrodes) $A_1$–$A_m$ are arranged extending in parallel in the vertical direction. At each of intersections of the cathode lines and the anode lines (a total of n×m locations), a light emitting layer of an organic electroluminescence element $E_{1,1}$–$E_{m,n}$ is sandwiched between associated cathode line and anode line. The elements $E_{1,1}$–$E_{m,n}$ carrying pixels are arranged in matrix, and each element has one end connected to an anode line (on the anode line side of the diode component E in the aforementioned equivalent circuit) and the other end connected to a cathode line (on the cathode line side of the diode component E in the aforementioned equivalent circuit) corresponding to the intersections of the anode lines $A_1$–$A_m$ along the vertical direction and the cathode lines $B_1$–$B_n$ along the horizontal direction. The cathode lines are connected to a cathode line scanning circuit 1 and driven thereby, while the anode lines are connected to an anode line driving circuit 2 and driven thereby.

The cathode line scanning circuit 1 has scanning switches $\mathbf{5}_1$–$\mathbf{5}_n$ corresponding to the cathode lines $B_1$–$B_n$ for individually determining potentials thereon. Each of the scanning switches $\mathbf{5}_1$–$\mathbf{5}_n$ connects a corresponding cathode line either to a reverse bias voltage $V_{CC}$ (for example, ten volts) derived from a power supply voltage or to a ground potential (zero volt).

The anode drive circuit 2 has current sources $\mathbf{2}_1$–$\mathbf{2}_m$ (for example, regulated current sources) corresponding to the anode lines $A_1$–$A_m$ for individually supplying the elements with driving currents through respective anode lines, and drive switches $\mathbf{6}_1$–$\mathbf{6}_n$ which are adapted to individually control on and off the currents flowing into the anode lines. While voltage sources such as regulated voltage sources could be used for the drive sources, current sources (power supply circuit controlled to supply a desired amount of current) are generally used for several reasons including the fact that the aforementioned current-luminance characteristic remains stable against temperature changes, whereas the voltage-luminance characteristic is unstable against temperature changes. The current sources $\mathbf{2}_1$–$\mathbf{2}_m$ supply the associated elements with such amounts of currents that are required to maintain the respective elements to emit light at desired instantaneous luminance (hereinafter this state is called the "steady light emitting state"). Also, When an element is in the steady light emitting state, the aforementioned capacitive element C is charged with a charge corresponding to the amount of supplied current, so that the voltage across both terminals of the element is at a regulated value Ve (hereinafter, this value is called the "light emission regulating voltage") corresponding to the instantaneous luminance.

The anode lines are also connected to an anode line reset circuit 3. The anode line reset circuit 3 has shunt switches $\mathbf{7}_1$–$\mathbf{7}_m$, disposed one for each anode line. Anode lines are connected to the ground potential, when associated shunt switches are selected.

The cathode line scanning circuit 1, the anode line drive circuit 2 and the anode line reset circuit 3 are connected to a light emission control circuit 4.

The light emission control circuit 4 controls the cathode line scanning circuit 1, the anode line drive circuit 2 and the anode line reset circuit 3 in accordance to the image data supplied from an image data generating system, not shown, so as to display an image represented by image data. The light emission control circuit 4 generates a scanning line selection control signal for controlling the cathode line scanning circuit 1 to switch the scanning switch $\mathbf{5}_1$–$\mathbf{5}_n$ such that any of the cathode lines corresponding to a horizontal scanning period of the image data is selected and set at the ground potential, and the remaining cathode lines are applied with the reverse bias voltage $V_{CC}$. The reverse bias voltage $V_{CC}$ is applied by regulated voltage sources connected to cathode lines in order to prevent crosstalk light emission from occurring in elements connected to intersections of a driven anode line and cathode lines which are not selected for scanning. The reverse bias voltage $V_{CC}$ is typically set equal to the light emission regulating voltage Ve ($V_{CC}$=Ve). As the scanning switches $\mathbf{5}_1$–$\mathbf{5}_n$ are sequentially switched to the ground potential in each horizontal scanning period, a cathode line set at the ground potential functions as a scanning line which enables the elements connected thereto to emit light.

The anode line drive circuit 2 conducts a light emission control for the scanning lines as mentioned above. The light emission control circuit 4 generates a drive control signal (driving pulse) in accordance with pixel information indicated by image data to instruct which of elements connected to associated scanning lines are driven to emit light at which timing and for approximately how long, and supplies the drive control signal to the anode line drive circuit 2. The anode line drive circuit 2, responsive to this drive control signal, controls on and off some of the drive switches $\mathbf{6}_1$–$\mathbf{6}_m$ to supply driving currents to associated elements through the anode lines $A_1$–$A_m$ in accordance with the pixel information. In this way, the elements supplied with the driving currents are forced to emit light in accordance with the pixel information.

The anode line reset circuit 3 performs its reset operation in response to a reset control signal from the light emission control circuit 4. The anode line reset circuit 3 turns on any of the shunt switches $\mathbf{7}_1$–$\mathbf{7}_m$ corresponding to anode lines to be reset, indicated by the reset control signal, and turns off the rest of the shunt switches $\mathbf{7}_1$–$\mathbf{7}_m$.

Japanese Patent Kokai No. 9-232074 commonly filed by the present applicant discloses a driving method for use in a simple matrix display panel for performing a reset operation to discharge an accumulated charge on each of elements arranged in lattice form immediately before scanning lines are switched (hereinafter called the "reset driving method"). This reset driving method permits elements to trigger light emission earlier when scanning lines are switched. This reset driving method for a simple matrix display panel will be explained below with reference to FIGS. 4 to 6.

The operation illustrated in FIGS. 4 to 6, described below, is taken as an example in which a cathode line $B_1$ is scanned to have elements $E_{1,1}$ and $E_{2,1}$ emit light, and subsequently, a cathode line $B_2$ is scanned to have elements $E_{2,2}$ and $E_{3,2}$ emit light. Also, for facilitating the understanding of the explanation, assume that a diode symbol represents an element which is emitting light, while a capacitor symbol represents an element which is not emitting light. Further, a reverse bias voltage $V_{CC}$ applied to cathode lines $B_1$–$B_n$ is set at ten volts which is identical to a light emission regulating voltage Ve of the elements.

Referring first to FIG. 4, only a scanning switch $\mathbf{5}_1$ is switched to the ground potential equal to zero volt to scan a cathode line $B_1$. The remaining cathode lines $B_2$–$B_n$ are applied with the reverse bias voltage $V_{CC}$ through the scanning switches $\mathbf{5}_2$–$\mathbf{5}_n$. Simultaneously, anode lines $A_1$ and $A_2$ are connected to current sources $\mathbf{2}_1$ and $\mathbf{2}_2$ through drive switches $\mathbf{6}_1$ and $\mathbf{6}_2$, respectively. The remaining anode lines $A_3$–$A_m$ are switched to the ground potential at zero volt through shunt switches $\mathbf{7}_3$–$\mathbf{7}_m$. Thus, in the state illustrated in FIG. 4, the elements $E_{1,1}$ and $E_{2,1}$ only are forwardly biased so that driving currents flow thereinto from the current sources $\mathbf{2}_1$ and $\mathbf{2}_2$ as indicated by arrows, causing only the elements $E_{1,1}$ and $E_{2,1}$ to emit light. In this state, the elements $E_{3,2}$ and $E_{m,n}$ which are not emitting light, indicated by hatching, are charged with polarities as indicated in the drawing.

Immediately before proceeding from the steady light emitting state of FIG. 4 to a state in which the next elements $E_{2,2}$ and $E_{3,2}$ are driven to emit light, the following reset control is performed. Specifically, as illustrated in FIG. 5, all the drive switches $\mathbf{6}_1$–$\mathbf{6}_m$ are opened, all the scanning switches $\mathbf{5}_1$–$\mathbf{5}_n$ and all the shunt switches $\mathbf{7}_1$–$\mathbf{7}^m$ are switched to the ground potential at zero volt, and all of the anode lines $A_1$–$A_m$ and the cathode lines $B_1$–$B_n$ are once shunted to the ground potential at zero volt, thus fully resetting the entire display panel. As a result of this full reset operation, all of the anode lines and the cathode lines are at the same potential equal to zero volt, so that charges stored in the respective elements are discharged through routes as indicated by arrows in the drawing, whereby the charges stored in all the elements are eliminated in a flash.

After eliminating the charges stored in all the elements in this way, only the scanning switch $\mathbf{5}_2$ corresponding to the cathode line $B_2$ is next switched to zero volt to scan the cathode line $B_2$, as illustrated in FIG. 6. Simultaneously with this, the drive switches $\mathbf{6}_2$ and $\mathbf{6}_3$ are closed to connect the current sources $\mathbf{2}_2$ and $\mathbf{2}_3$ to anode lines corresponding thereto, and the shunt switches $\mathbf{7}_1$, $\mathbf{7}_4$–$\mathbf{7}_m$ are turned on to apply the anode lines $A_1$, $A_4$–$A_m$ with zero volt.

As is understood, the light emission control according to the reset driving method involves repetitions of a scanning mode which is a period in which any of the cathode lines $B_1$–$B_n$ is made active, and a reset mode subsequent thereto. The scanning mode and the reset mode are performed every one horizontal scanning period (1H) of image data. Assuming that a transition is made directly from the state of FIG. 4 to the state of FIG. 6 without performing the reset control, a driving current supplied from the current source $\mathbf{2}_3$, for example, not only flows into the element $E_{3,2}$ but also is consumed for canceling reversely directed charges stored in the elements $E_{3,3}$–$E_{3,n}$ (shown in FIG. 4), thereby requiring an extra time to bring the element $E_{3,2}$ into the steady light emitting state (the voltage across both terminals of the element $E_{3,2}$ is increased to the light emission regulating voltage Ve).

However, the above-mentioned reset control, if performed, results in the potentials at the anode lines $A_2$ and $A_3$ increased to approximately $V_{CC}$ at the moment the scanning is switched to the cathode line $B_2$, so that the elements $E_{2,2}$ and $E_{3,2}$, which must be driven to emit light next time, are applied with charging currents flowing thereinto not only from the current sources $\mathbf{2}_2$ and $\mathbf{2}_3$ but also from a plurality of routes from regulated voltage sources connected to the cathode lines $B_1$, $B_3$–$B_n$. These charging currents charge parasitic capacitances to allow the voltages applied to the elements to instantaneously reach the light emission regulating voltage Ve, thereby accomplishing instantaneous transition to the steady light emitting state. Subsequently, since the amounts of current supplied from the associated current sources are enough for the elements to maintain the steady light emitting state at the light emission regulating voltage Ve during the scanning period of the cathode line $B_2$, currents supplied from the current sources $\mathbf{2}_2$ and $\mathbf{2}_3$ flow only into the elements $E_{2,2}$ and $E_{3,2}$ and are consumed only for the light emission. In other words, the light emitting state illustrated in FIG. 6 is maintained.

As described above, according to the conventional reset driving method, since all of the cathode lines and the anode lines are once connected to zero volt or the ground potential or the potential equal to the reverse bias voltage $V_{CC}$ and reset before the transition to the light emission control for the next scanning line, the charging up to the light emission regulation voltage Ve can be achieved faster at the time the light emission control is switched to the next scanning line, thereby allowing elements on the switched scanning line, which should emit light, to trigger the light emission earlier.

The voltage levels on the cathode lines and the anode lines in the operations illustrated in FIGS. 4 to 6 can be represented in timing chart form as shown in FIGS. 7A, 7B. In a first scanning period, elements located at the intersections of the cathode line $B_1$ and the anode lines $A_1$, $A_2$ are applied with a voltage across both terminals thereof at an anode line voltage level $V_{AA}$ (equal to Ve in FIGS. 4 to 6) and emit light at a luminance corresponding to this level $V_{AA}$. In a second scanning period, element located at the intersections of the cathode line $B_2$ and the anode lines $A_2$, $A_3$ are applied with a voltage across both terminals thereof at the anode line voltage level $V_{AA}$ (equal to Ve in FIGS. 4 to 6) and emit light at a luminance corresponding to this level $V_{AA}$.

It should be noted that when the luminance is adjusted in a light emitting display employing the conventional reset driving method as described above, a luminance adjusting method common to matrix displays is applied for this purpose. Specifically, there are two modes for adjusting the luminance: a pulse width modulation mode and a pulse level modulation mode. The pulse width modulation mode is performed such that, as shown in FIG. 7A, the level of a voltage across both ends of an element during light emission is maintained at a fixed value (i.e., the element is driven to emit light at a fixed instantaneous luminance by a fixed driving current), and a connecting time period of a drive source to an associated anode line is varied within a range of the scanning period to adjust the luminance of light emitted by each element. The pulse level modulation mode, in turn, is performed such that, as shown in FIG. 7B, an anode line is connected to an associated drive source for a fixed duration corresponded to the scanning period, and the level of a voltage across both terminals of an associated element is varied every scanning period by the drive source (a driving current level is varied) to control the luminance of light emitted by each element. The method shown in FIG. 7A employs a regulated current source capable of supplying a fixed current at all times as the drive source since the elements have a fixed instantaneous luminance. The method shown in FIG. 7B, on the other hand, employs a variable current source as the drive source such that the elements have an instantaneous luminance which is fixed within a scanning period and variable from one scanning period to another. The luminance is reproduced by these methods.

The simple matrix display panel which executes the reset driving method as described above, however, has the following problems when the elements are adjusted for the luminance. The pulse width modulation mode as shown in FIG. 7A relies only on the length of the driving time for weighting of gradation, thus leading to a limited adjustable range and difficulties in reproducing multi-level gradation over a wide range. The pulse level modulation mode as shown in FIG. 7B, on the other hand, experiences difficulties in accurately adjusting the voltage level across both terminals of the elements during light emission every scanning period and as a result, suffers from a degraded linearity of luminance gradation. This is in part due to the use of the current sources as drive sources for driving the anode lines (drive sources controlled to supply a predetermined amount of current), and in part due to the levels of the voltages across both terminals of the elements unconditionally becoming substantially equal to the reverse bias voltage $V_{CC}$ at the moment a transition to a scanning period has been made through a reset period. Therefore, if the luminance is adjusted by varying the level of the voltage across both terminals of each element every scanning period as is the case of FIG. 7B, the voltage across both terminal of the element fails to have an ideal state as illustrated, thus resulting in the inability of accurately reproducing a desired luminance level.

FIG. 8 shows an actual level of a voltage across both terminal of an element, observed when the luminance is adjusted by the method illustrated in FIG. 7B. Specifically, in the simple matrix display panel employing the conventional reset driving method illustrated in FIGS. 4 to 6, the luminance adjusting method shown in FIG. 7B is implemented. As mentioned above, the luminance level L of an element has a value corresponding to the level of a voltage across both terminals of the element. Referring specifically to FIG. 8, light emission is conducted at a standard luminance during a $j^{th}$ scanning period; at a maximum luminance during a $(j+1)^{th}$ scanning period; and at a minimum luminance during a $(j+2)^{th}$ scanning period. The level of a voltage across both terminals of the element corresponding to a desired instantaneous luminance is $Ve_0$ during the $j^{th}$ scanning period; $Ve^{max}$ during the $(j+1)^{th}$ scanning period; and $Ve_{min}$ during the $(j+2)^{th}$ scanning period. It should be noted that the voltage level $Ve_0$ across both terminal of the element, when it emits light at the standard luminance, is set equal to the reverse bias voltage $V_{CC}$, and the current sources $\mathbf{2}_1$–$\mathbf{2}_m$ of the anode line drive circuit 2 are variable current sources which vary their respective amounts of supplied currents every scanning period (current sources controlled to supply the amount of current adjustable to a desired value).

As shown in FIG. 8, at the moment a transition to the $j^{th}$ scanning period has been made through a reset period, the potential level on an anode line connected to an element driven to emit light becomes substantially equal to the reverse bias voltage $V_{CC}$ in a flash, so that the level of a voltage across both terminals of the element is increased to approximately $Ve_0$ just from the moment of the transition to the $j^{th}$ scanning period, thus enabling the element to emit light at a desired instantaneous luminance. Subsequently, since the element is supplied with and consumes a fixed amount of current from the variable current source only sufficient to emit light at the standard luminance, the element maintains the light continuously emitted at a constant luminance and the voltage level across both terminals thereof at $Ve_0$.

Next, at the moment a transition to the $(j+1)^{th}$ scanning period has been made through a reset period, the potential level of the anode line is increased only to $V_{CC}$ as is the case of the $j^{th}$ scanning period, so that the level of a voltage across both terminals of the element does not reach the desired value, i.e., $Ve_{max}$, resulting in the instantaneous luminance of the element lower than a desired luminance value. Subsequently, a current supplied from the variable current source distributively flows into parasitic capacitances of a plurality of elements connected to the drive line, and charges the parasitic capacitances, so that,the potential on the drive line is increased, and together with this, the voltage across both terminals of the element driven to emit light is also increased toward $Ve_{max}$. However, the amount of current supplied from the variable current source is fixed in correspondence to the instantaneous luminance of the light emitted by the element during the $(j+1)^{th}$ scanning period. Thus, if the fixed amount of current flows into the parasitic capacitances of all elements connected to the drive line, the potential on the drive line will increase slowly, causing the voltage across both terminals of the element driven to emit light to similarly increase slowly as shown in FIG. 8. Then, at the time the potential on the drive line reaches $Ve_{max}$, the voltage across both terminals of the element becomes stable. As a result, during the $(j+1)^{th}$ scanning period, the luminance is insufficient with respect to the desired luminance by a portion corresponding to a hatched area X, thus failing to reproduce the desired luminance.

Next, at the moment a transition to the $(j+2)^{th}$ scanning period has been made through a reset period, the potential level on the anode line is increased to $V_{CC}$ as is the case of the $j^{th}$ scanning period, so that the level of a voltage across both terminals of the element becomes larger than the desired value, i.e., $Ve_{min}$, resulting in the instantaneous luminance of the element higher than a desired luminance value. Subsequently, since the amount of current supplied from the variable current source is smaller than that during the $j^{th}$ scanning, currents from scanning lines not selected as well as the current supplied from the variable current source attempt to flow into the element driven to emit light. This causes elements on the scanning line, not selected, to be gradually charged with charges of the opposite direction by the reverse bias voltage source, so that the potential on the drive line slowly drops, and a voltage across both terminals of the element driven to emit light also drops slowly as shown. Eventually, when the potential on the drive line reaches $Ve_{min}$, the voltage across both terminals of the element becomes stable. As a result, during the $(j+2)^{th}$ scanning period, the luminance is excessive with respect to the desired luminance by a portion corresponding to a hatched area Y, thus failing to reproduce the desired luminance.

OBJECT AND SUMMARY OF THE INVENTION

The present invention has been made in view of the problems described above, and its object is to provide a capacitive light-emitting element display device which is capable of extending a luminance adjustable range, and accomplishing a luminance adjustment with a good linearity.

In a first aspect, the present invention provides a method of driving a capacitive light-emitting element display device having a plurality of capacitive light-emitting elements arranged at a plurality of intersections of drive lines and scanning lines and connected between the scanning lines and the drive lines. The method includes the steps of connecting the scanning lines to either first or second potential, wherein the first and second potential are different from each other; connecting the drive lines to either the lower potential of the first and second potentials or a drive source; and in synchronism with a scanning period in which selected one of the scanning lines is connected to the lower potential of the first and second potentials, connecting selected one of the drive lines to the drive source to force a capacitive light-emitting element associated therewith to emit light, and simultaneously connecting the scanning lines, not selected, to the lower potential of the first and second potentials, wherein the higher potential of the first and second potentials is made adjustable.

The driving method further includes the step of resetting all the capacitive light-emitting elements during a reset period between the scanning periods.

The higher potential of the first and second potentials is made adjustable from one field period to another, and is maintained at a fixed potential during each field period.

The drive source may be a regulated current source.

The higher potential of the first and second potentials is adjusted within a range higher than a potential derived by subtracting a light emission threshold voltage from a light emission regulating voltage of the element, and the lower potential of the first and second potentials may be a ground potential.

Alteratively, the drive source may be a variable current source.

The higher potential of the first and second potentials is adjusted to be substantially equal to a light emission regulating voltage of the light emitting element, and the lower potential of the first and second potentials may be a ground potential.

During the reset period, the drive lines and the scanning lines is set at the same potential.

During the scanning period, the remaining drive lines except for the selected drive line connected to the drive source is connected to the lower one of the first and second potentials.

Preferably, the capacitive light-emitting elements are organic electroluminescence elements.

In a second aspect, the present invention provides a capacitive light-emitting element display device comprising a plurality of capacitive light-emitting elements arranged at a plurality of intersections of drive lines and scanning lines and connected between the scanning lines and the drive lines; scanning switch means for connecting the scanning lines to either first or second potential, wherein the first and second potentials are different from each other; drive switch means for connecting the drive lines to the lower potential of the first and second potentials or a drive source; light emission control means for controlling the drive switch means and the scanning switch means, wherein the light emission control means is operative in synchronism with a scanning period in which the scanning switch means connects selected one of the scanning lines to the lower potential of the first and second potentials for controlling the drive switch means to selectively connect the drive lines to the drive source to force selected capacitive light-emitting elements to emit light, and simultaneously controlling the scanning switch means to connect the scanning lines, not selected, to the lower potential of the first and second potentials; and adjusting means for adjusting the higher potential of the first and second potentials.

The light emission control means defines a period between the scanning periods for resetting all the capacitive light-emitting elements are reset.

Also, the adjusting means adjusts the higher potential of the first and second potentials from one field period to another, and maintains the higher potential at a fixed potential during each field period.

The drive source may be a regulated current source.

The adjusting means adjusts the higher potential of the first and second potentials within a range higher than a potential derived by subtracting a light emission threshold voltage from a light emission regulating voltage of the element, and the lower potential of the first and second potentials is a ground potential.

Alternatively, the drive source may be a variable current source.

The adjusting means.adjusts the higher potential of the first and second potentials to be substantially equal to the light emission regulating voltage of the light emitting element, and the lower potential of the first and second potentials is a ground potential.

The light emission control means sets the drive lines and the scanning lines at the same potential during the reset period.

The light emission control means connects the remaining drive lines except for the selected drive line connected to the drive source to the lower one of the first and second potentials during the scanning period.

Preferably, the capacitive light-emitting elements are organic electroluminescence elements.

BRIEF DESCRIPTION OF THE DRAWINGS

FIGS. 13A, 13B, 13C are timing charts showing another aspect of the reset driving method for a display device according to the present invention.

DETAILED DESCRIPTION OF THE PREFERRED EMBODIMENTS

Embodiments of the present invention will hereinafter be described in detail with reference to the accompanying drawings.

Figure 9:
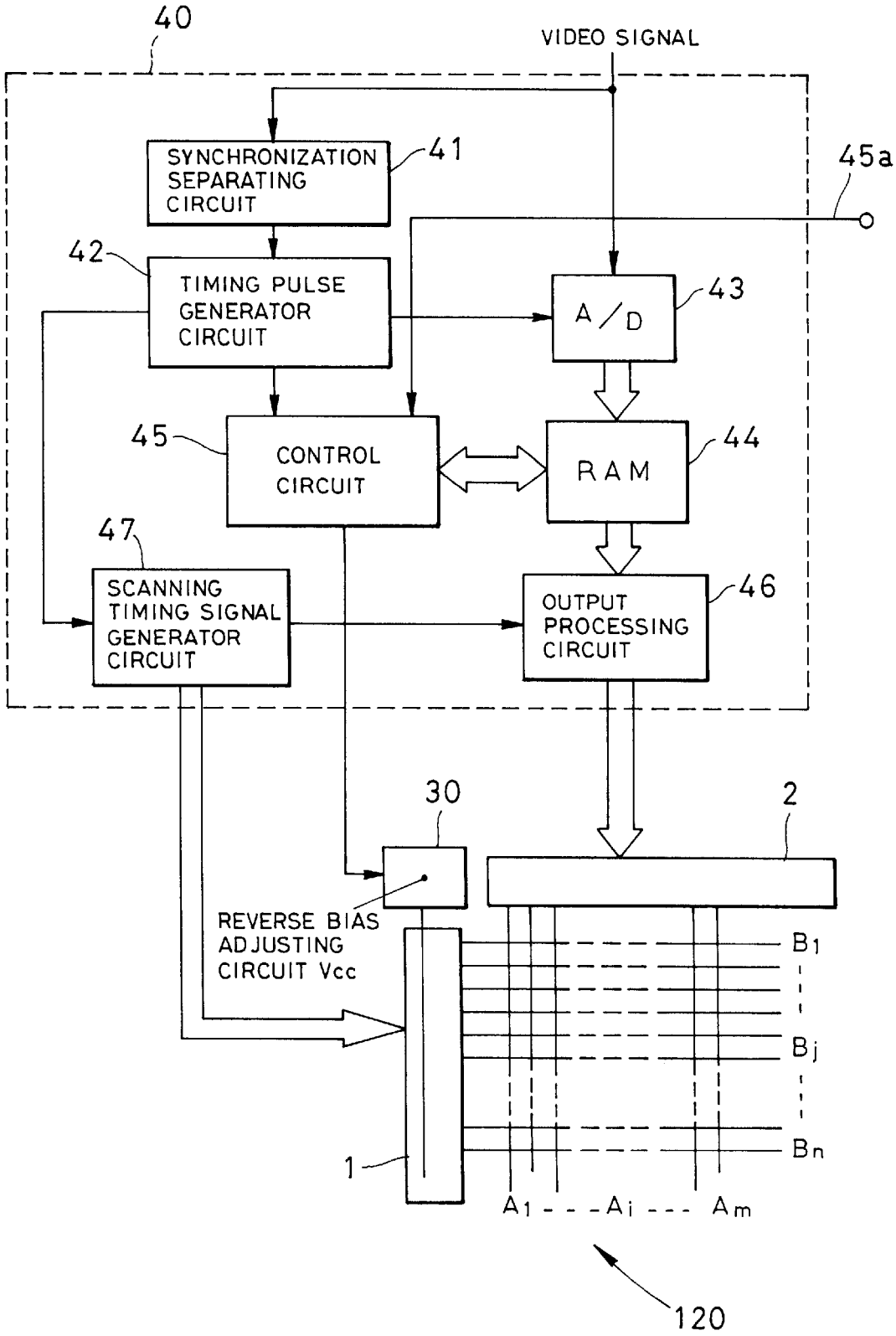
FIG. 9 is a block diagram for explaining the configuration of a display device using organic electroluminescence elements according to the present invention.

FIG. 9 generally illustrates the configuration of a display device according to an embodiment of the present invention which uses an organic electroluminescence elements, i.e., capacitive light-emitting elements. The display device has a capacitive light-emitting panel 120 and a light emission controller 40.

Figure 1:
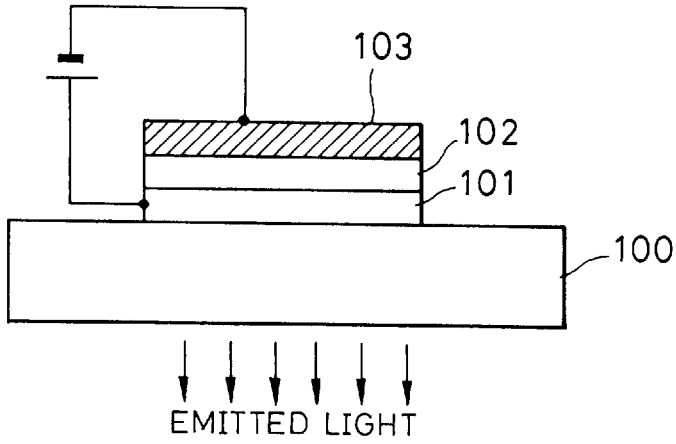
FIG. 1 is a cross-sectional view of an organic electroluminescence element.
Figure 2:
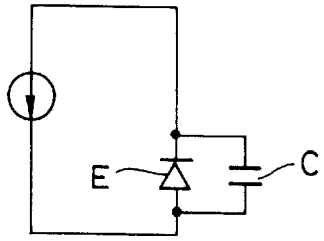
FIG. 2 is a diagram illustrating an equivalent circuit of the organic electroluminescence element of FIG. 1.
Figure 3:
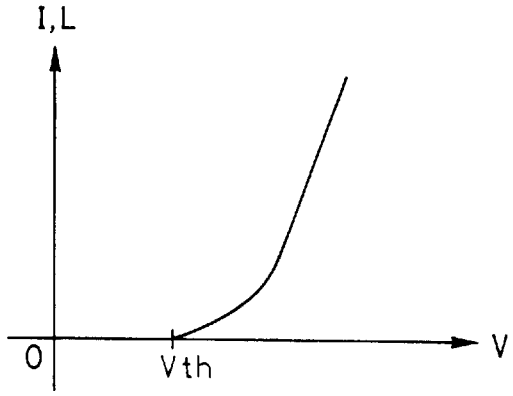
FIG. 3 is a graph generally showing the driving voltage—current—luminance of emitted light characteristics of the organic electroluminescence element.
Figure 4:
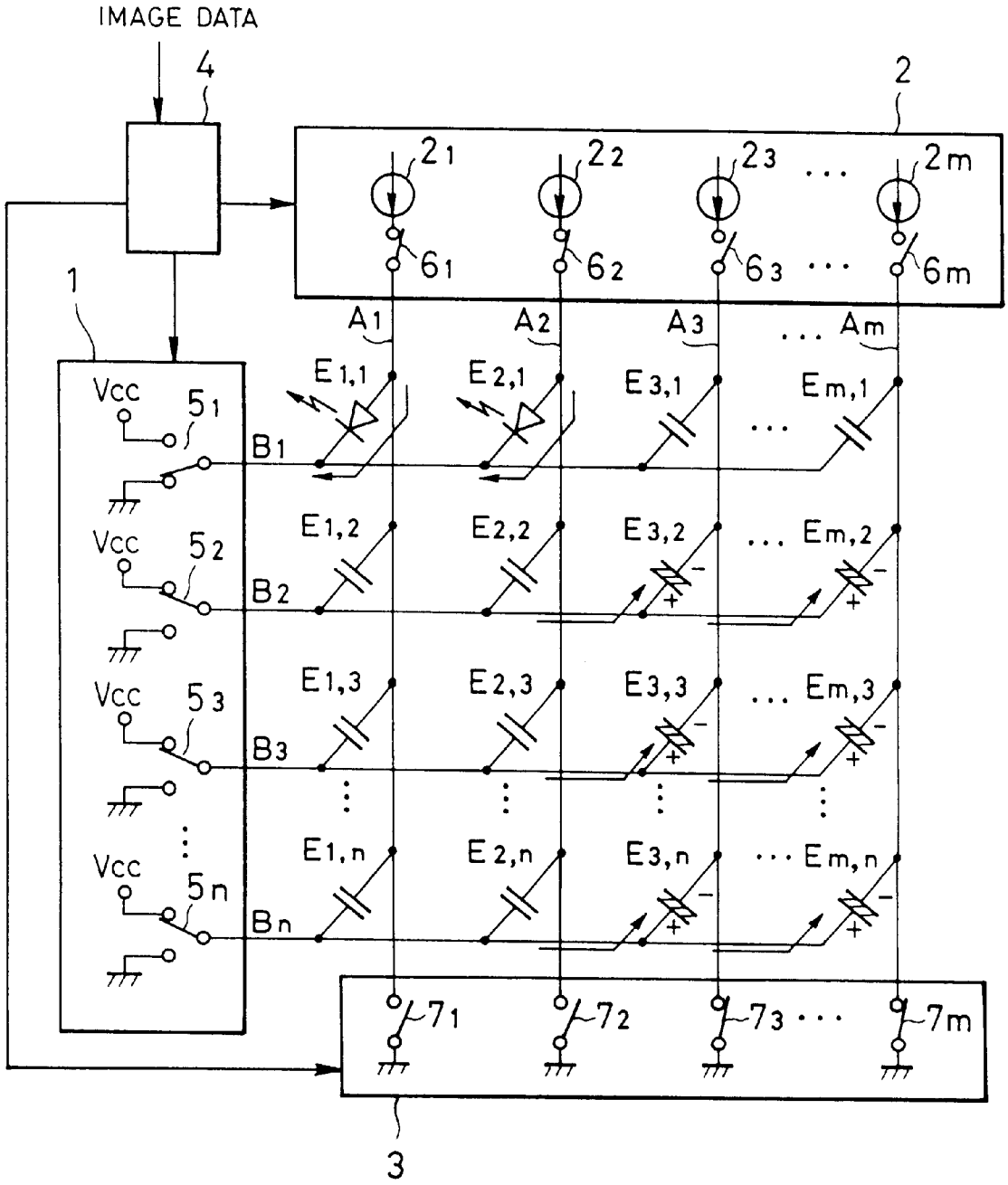
FIGS. 4 to 6 are block diagrams for explaining the configuration of a conventional display device using organic electroluminescence elements and a zero-volt reset driving method applied thereto.
Figure 5:
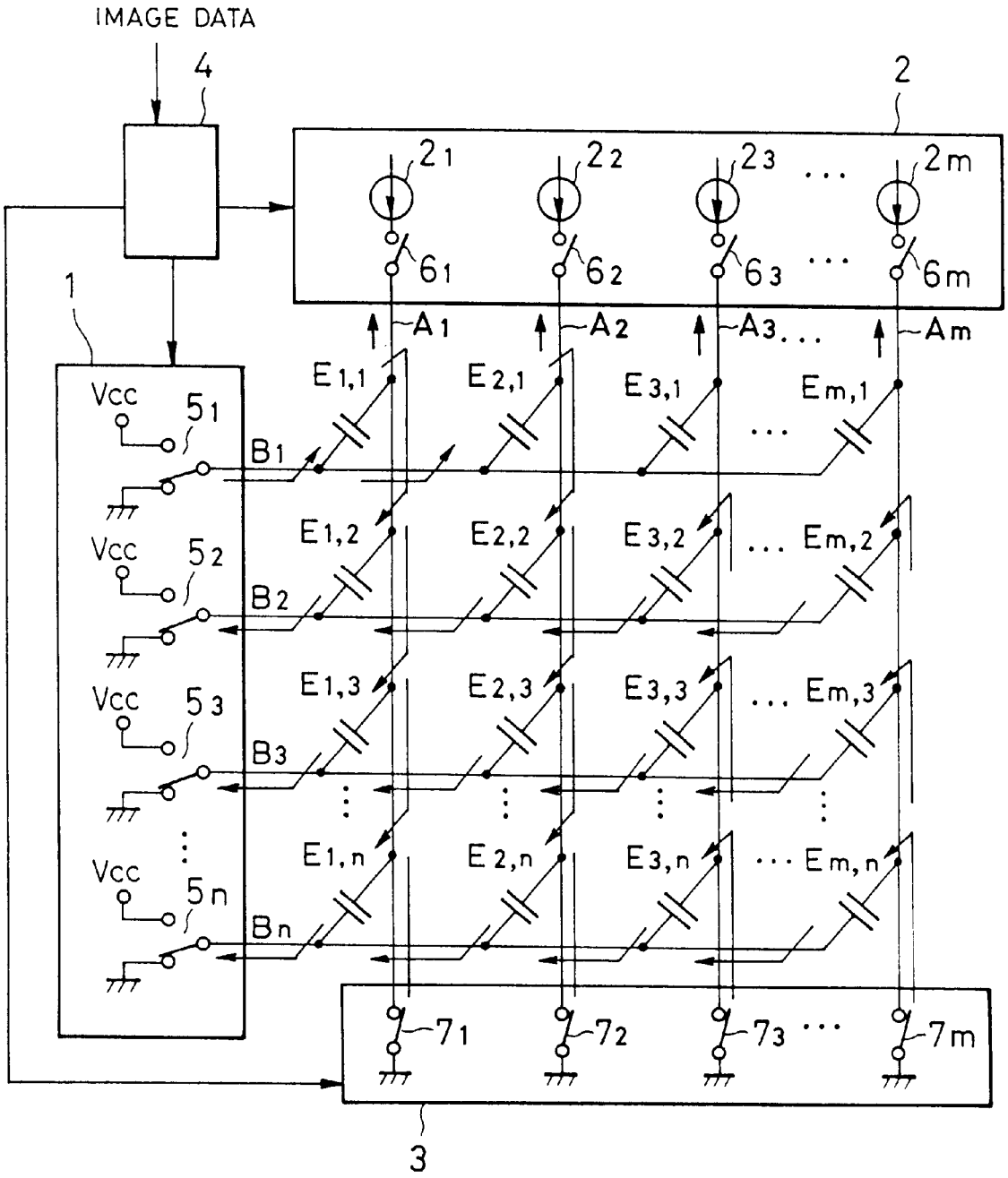
Figure 6:
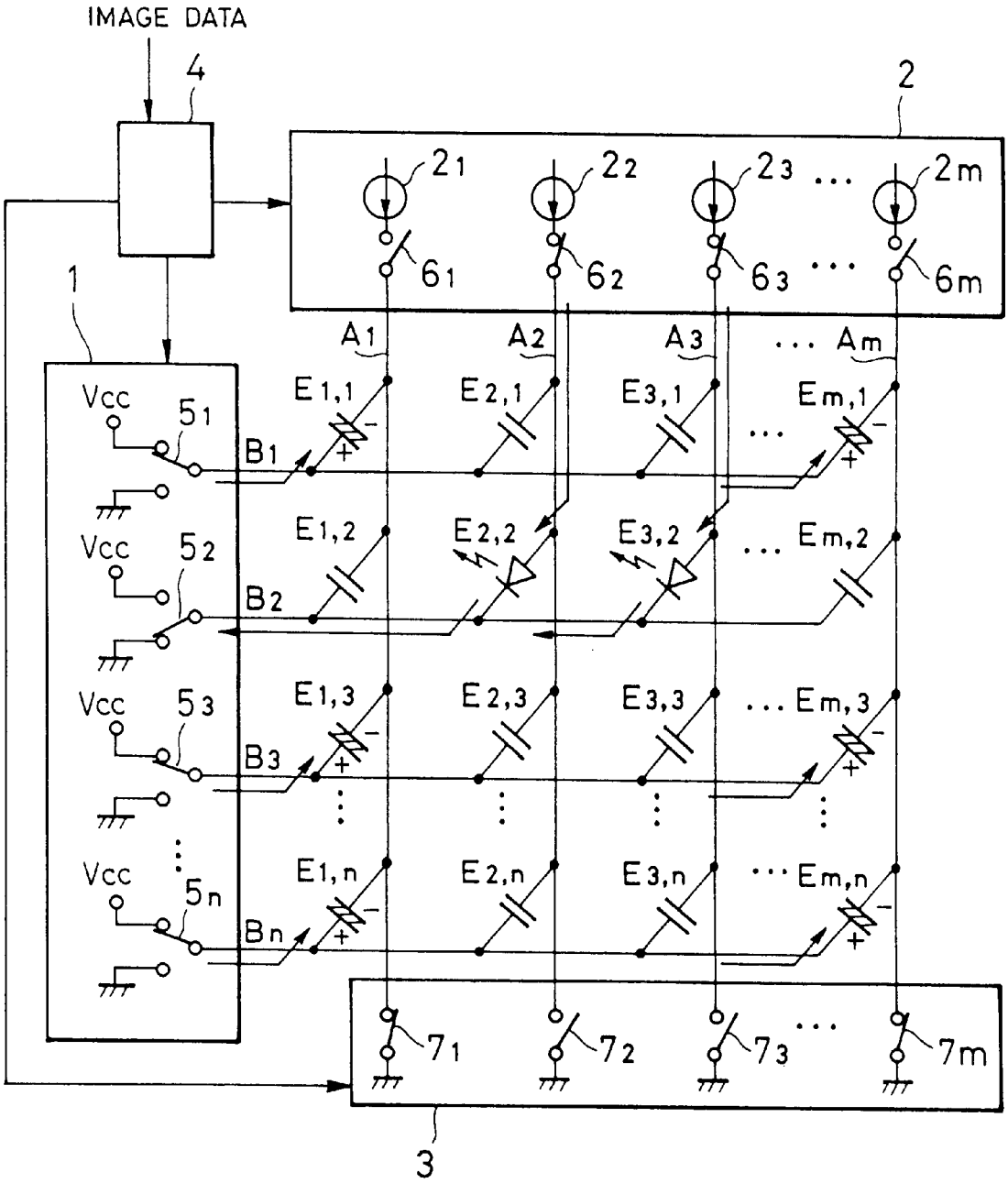

The light-emitting panel 120 includes a cathode line scanning circuit 1 which functions as a scanning switch means that can connect each scanning line to one of different potentials, for example, a ground potential and a reverse bias potential; an anode line drive circuit 2 which functions as a drive switch means that can connect each drive line to at least one of the ground potential and the reverse bias potential or to a drive source; and a reverse bias adjusting circuit 30 for adjusting the magnitude of the reverse bias potential. In the light emitting panel 120, similar to that previously illustrated in FIGS. 4 to 6, a plurality of organic electroluminescence elements $E_{i,j}$ (1=i=m, 1=j=n) are arranged in matrix at plurality of intersections of anode lines $A_1$–$A_m$ functioning as drive lines and cathode lines $B_1$–$B_n$ functioning as scanning lines, and are each connected between associated scanning line and drive line. State another way, the organic electroluminescence elements are arranged at respective intersections of a plurality of drive lines extending substantially in parallel and a plurality of scanning lines extending substantially perpendicular to the drive lines and substantially in parallel with each other, and are each connected to associated scanning line and drive line.

As illustrated in FIG. 9, the cathode line scanning circuit 1 has scanning switches $\mathbf{5}_1$–$\mathbf{5}_n$ corresponding to the cathode lines $B_1$–$B_n$, each of which connects either of a reverse bias current $V_{CC}$ derived from a supply voltage and a ground potential to a corresponding cathode line. The anode line drive circuit 2 has drive switches $\mathbf{6}_1$–$\mathbf{6}_m$, corresponding to the anode lines $A_1$–$A_m$, which are switched either to current sources $\mathbf{2}_1$–$\mathbf{2}_m$ or to the ground potential, and controls the drive switches $\mathbf{6}_1$–$\mathbf{6}_m$ on and off such that currents individually flow therethrough to associated anode lines.

The cathode lines $B_1$–$B_n$ are controlled by the scanning switches in accordance with a switching control based on a so-called line sequence scanning mode, where the cathode lines $B_1$–$B_n$ are sequentially switched to the ground potential every horizontal scanning period, and otherwise to the reverse bias voltage $V_{CC}$. Alternatively, the cathode lines $B_1$–$B_n$ may be controlled by the cathode scanning circuit 1 in accordance with an interlace scanning mode instead of the line sequence scanning mode. It should be noted that $V_{CC}$ must be chosen to be larger than Ve-Vth to prevent unselected elements from erroneously emitting light. The anode lines $A_1$–$A_m$ are supplied with image data through the associated drive switches of the anode line driving circuit 2. Thus, the cathode lines function as scanning lines for enabling elements connected thereto to emit light, while the anode lines function as drive lines for driving elements connected thereto to emit light.

A light emission controller 40 is a light emission control means which is connected to the cathode line scanning circuit 1 and the anode line drive circuit 2 to control these circuits. The light emission controller 40 controls the cathode line scanning circuit 1 and the anode line drive circuit 2 such that the anode line drive circuit 2 selectively connects drive lines to drive sources to force selected elements to emit light in synchronism with scanning periods in which the cathode line scanning circuit 1 periodically connects any of the scanning lines to the ground potential.

Within the light emission controller 40, a synchronization separating circuit 41 extracts horizontal and vertical synchronization signals from an input video signal supplied to the display device, and supplies these synchronization signals to a timing pulse generator circuit 42. The timing pulse generator circuit 42 generates a synchronization signal timing pulse based on these extracted horizontal and vertical synchronization signals, and supplies the synchronization signal timing pulse to an A/D converter 43, a control circuit 45 and a scanning timing signal generator circuit 47, respectively. The A/D converter 43 converts the input video signal to corresponding digital pixel data on pixel-by-pixel basis in synchronism with the synchronization signal timing pulse, and supplies the digital pixel data to a memory 44. The control circuit 45 supplies the reverse bias adjusting circuit 30 with a reverse bias potential control signal based on a driving method, later described, and supplies the memory 44 with a write signal and a read signal in synchronism with the synchronization signal timing pulse. The memory 44 sequentially fetches each pixel data supplied from the A/D converter 43 in response to the write signal. Also, the memory 44 sequentially outputs pixel data stored therein in response to the read signal, and supplies the read pixel data to an output processing circuit 46 at the next stage. The scanning timing signal generator circuit 47 generates a variety of timing signals for controlling the scanning switches and the drive switches, and supplies these timing signals to the cathode line scanning circuit 1 and the output processing circuit 46, respectively. The output processing circuit 46 supplies the anode line drive circuit 2 with pixel data supplied from the memory 44 in synchronism with the timing signal from the scanning timing signal generator circuit 47. The control circuit 45 generates a luminance signal from the pixel data through the output processing circuit 46 by way of a comb filter, a luminance level control circuit and so on, and supplies the luminance signal to the drive sources of the anode line driving circuit 2. The control circuit 45 also receives an electric signal corresponding to a manual adjustment by the user or to the output of an external photosensor from an external signal line 45*a* to set the reverse bias potential control signal additionally in accordance to this signal.

Figure 10:
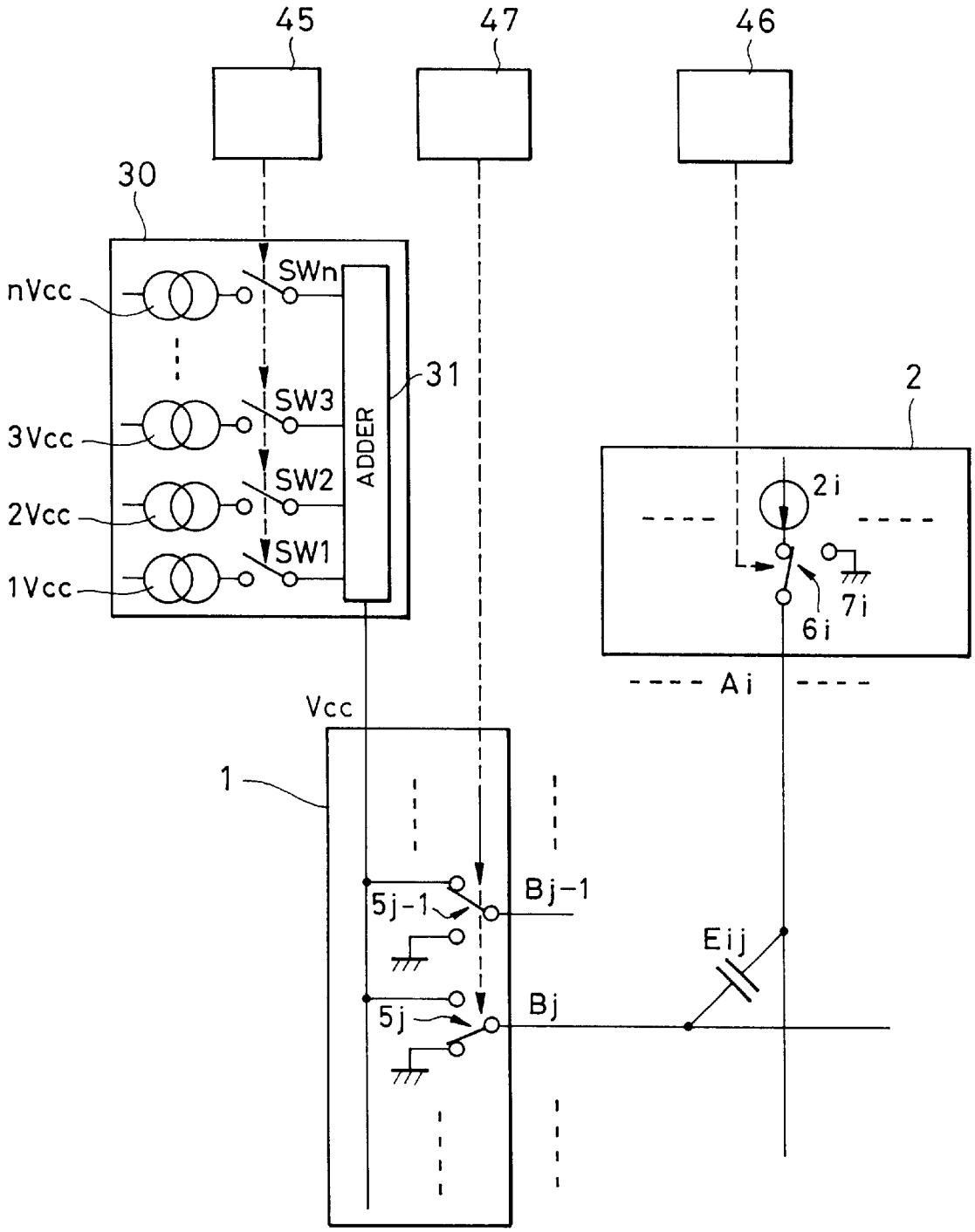
FIG. 10 is a block diagram illustrating a main portion of the display device using organic electroluminescence elements of FIG. 9.

FIG. 10 illustrates a main portion of the light emitting panel 120. The reverse bias adjusting circuit 30 for adjusting the magnitude of the reverse bias potential is a variable voltage source as a whole, and includes an adder 31 which is connected to a plurality of regulated voltage sources $1V_{CC}$–$nV_{CC}$ for supplying different potentials through switches SW1–SWn, respectively. The switch SW1–SWn are selectively controlled on and off in response to the reverse bias potential control signal from the control circuit 45. The adder 31 is connected to reverse bias voltage $V_{CC}$ terminals of the scanning switches through a bus line of the cathode line scanning circuit 1. The adder 31 outputs the sum of added outputs of selected regulated voltage supplies to the cathode line scanning circuit 1 as a reverse bias. The reverse bias voltage $V_{CC}$ made up of the sum of some of the regulated voltage sources $1V_{CC}$–$nV_{CC}$ selected by the switches SW1–SWn is set as a level at which a reference luminance is determined each time the cathode lines $B_1$–$B_n$, or the scanning lines are fully scanned, in other words, for each image frame. In this way, the reverse bias adjusting circuit 30 sets the reverse bias potential level in accordance with the signal from the control circuit 45. It should be noted that while there are essentially a plurality of drive lines, scanning lines and corresponding switches, those associated with a drive line $A_i$ and a scanning line $B_j$ are representatively illustrated in FIG. 10 for simplifying the illustration.

Figure 11:
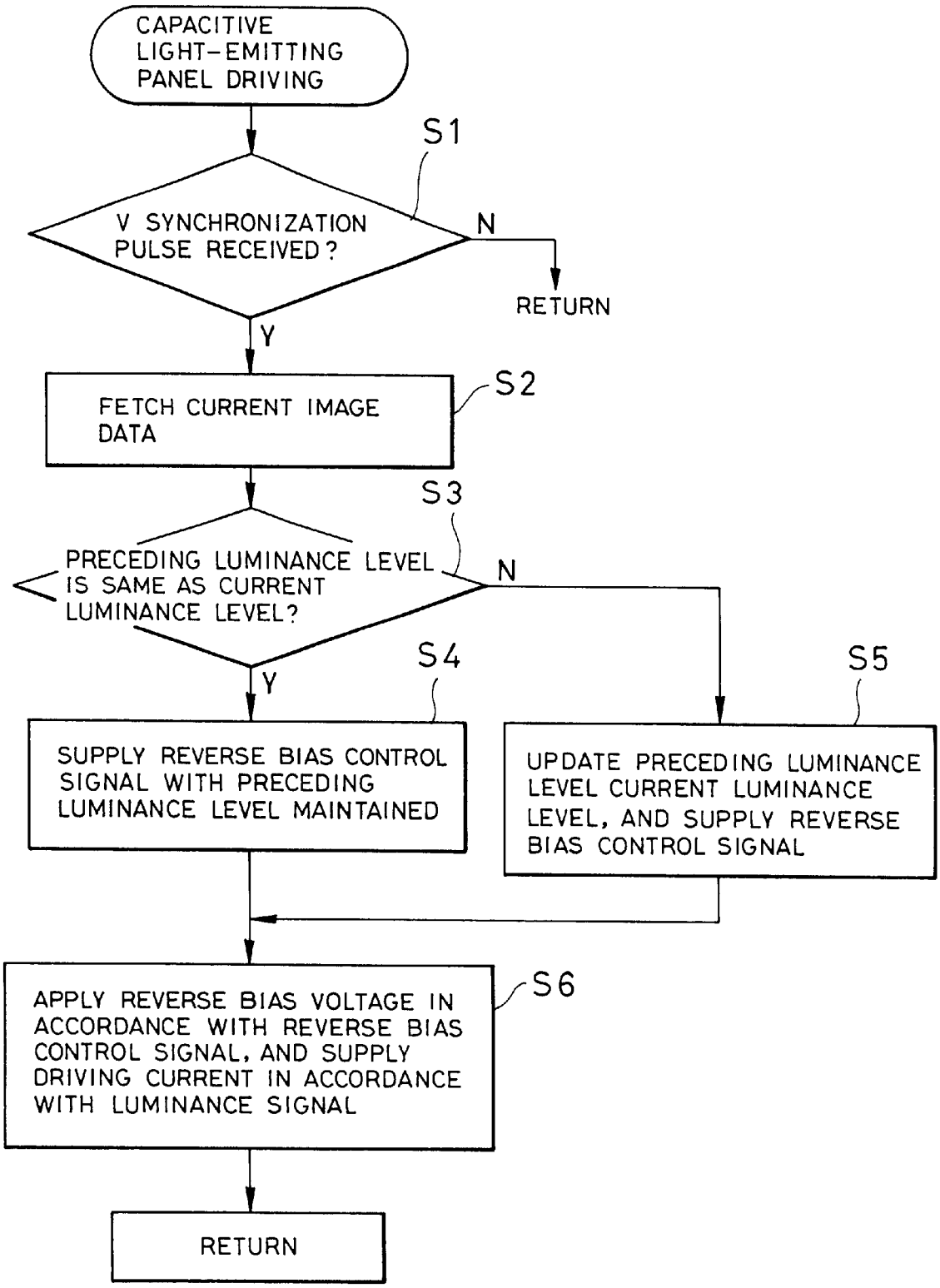
FIG. 11 is a flow chart illustrating a procedure of a reset driving method for a display device according to the present invention.

Next, a method of driving the capacitive light-emitting panel in the light emission control circuit 40 will be explained with reference to FIG. 11.

First, the control circuit 45 determines whether or not the memory 44 has received a vertical (V) synchronization pulse, indicative of one field (step 1).

Next, the control circuit 45 fetches a current one-field portion of image data from the memory 44 and stores the data therein (step 2).

Next, the control circuit 45 compares the luminance signal levels between one field portion of image data stored at the preceding time and the current image data to determine whether or not the image data have the same light emission luminance (step 3). Instead of comparing the luminance signal levels between one field portion of image data stored at the preceding time and the current image data, the determination in step 3 as to whether or not the same light emission luminance is to be maintained can be made by using an electric signal on the external signal line 45*a*, corresponding to a manual adjustment by the user, for example.

Next, if they have the same light emission luminance, the control circuit 45 maintains the preceding luminance level value, supplies the reverse bias adjusting circuit 30 with the same reverse bias potential control signal as the preceding one j, returns the current one field portion of image data to the memory 44, and drives the drive lines via the drive switches of the anode line drive circuit 2 through the output processing circuit 46 (step 4).

Conversely, if the control circuit 45 determines at step 3 that the preceding and current image data do not have the same light emission luminance, the control circuit 45 updates the luminance level value in accordance with the current pixel data, supplies the reverse bias adjusting circuit 30 with a reverse bias potential control signal based on the updated luminance level value, returns the current one field portion of image data to the memory 44, and drives the drive lines via the drive switches of the anode line drive circuit 2 through the output processing circuit 46 (step 5).

Next, after the completion of the foregoing mode, the cathode line scanning circuit 1 applies those cathode lines $B_1$–$B_n$, not subjected to the scanning, with the reverse bias voltage $V_{CC}$ in accordance with the reverse potential control signal over the current field period. Also, the anode line driving circuit 2 sequentially supplies a driving current in accordance with the pixel data every one horizontal scanning period over the current one field period (step 6).

The driving current is defined as a current in accordance with a luminance signal, and a fixed amount of current is supplied for a time period in accordance with the luminance when the pulse width modulation mode is employed, while a predetermine amount of current, determined in accordance with the luminance in each scanning period, is supplied for a fixed time period when the pulse level modulation mode is employed.

Alternatively, the reverse bias voltage $V_{CC}$ may be switched every one horizontal period rather than every field.

Further, in the foregoing embodiment, the cathode lines are arranged in the horizontal direction, while the anode lines are arranged in the vertical direction. Alternatively, the anode lines may be arranged in the horizontal direction, and the cathode lines may be arranged in the vertical direction. In addition, while the electrodes disposed in the horizontal direction are used for scanning, and the electrodes disposed in the vertical directions are used to control the luminance, the electrodes disposed in the vertical directions may be used for scanning, and the electrodes disposed in the horizontal direction may be used to control the luminance. It should be noted however that when the anode lines are used for scanning, driving power sources for the anode lines and cathode lines should have reverse polarities to those in the foregoing explanation.

Next, an embodiment will be explained in connection with changes in actual luminance level which are observed when the capacitive light-emitting panel driver illustrated in FIGS. 9 and 10 is driven by a driving method according to the method illustrated in FIG. 11, where the reverse bias voltage $V_{CC}$ is switched every one horizontal period as mentioned above.

Figures 12A, 12B, 12C:
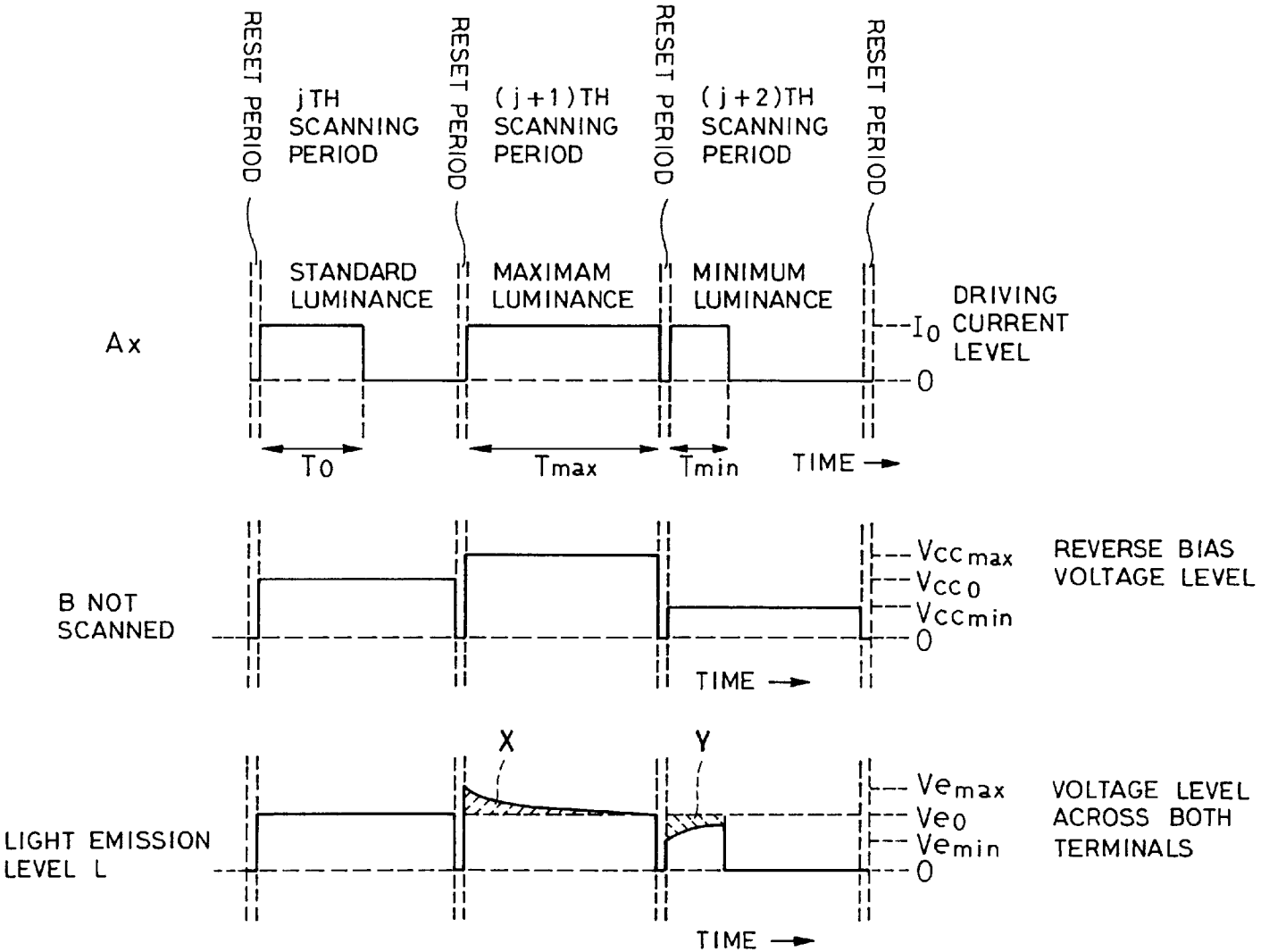
FIGS. 12A, 12B, 12C are timing charts showing one aspect of the reset driving method for a display device according to the present invention.

FIGS. 12A to 12C show that the capacitive light-emitting panel driver is driven by the pulse width modulation mode, wherein three consecutive elements connected to an anode line Ax are sequentially driven to emit light at a standard luminance during a $j^{th}$ scanning period; at a maximum luminance during a $(j+1)^{th}$ scanning period; and at a minimum luminance during a $(j+2)^{th}$ scanning period. As can be seen, the aforementioned reset period exists between respective scanning periods. FIG. 12A shows the waveform of a driving current. The elements ate applied with driving current pulses which have a fixed current level $I_0$ and a varying duration corresponding to the luminance during the $j^{th}$, $(j+1)^{th}$, and $(j+2)^{th}$ scanning periods. Specifically, as shown in the waveform chart, the driving current has a pulse width with a maximum value $T_{max}$ for a maximum luminance; a reference value $T_0$ for a standard luminance; and a minimum value $T_{min}$ for a minimum luminance. FIG. 12B shows the waveform of a reverse bias voltage level applied to cathode lines B other than that to be scanned. The cathode lines B are applied with a reverse bias voltage level corresponding to the luminance in each scanning period, and specifically applied with a maximum value $V_{CCmax}$ for the maximum luminance; a reference value $V_{CC0}$ for the standard luminance; and a minimum value $V_{CCmin}$ for the minimum luminance.

FIG. 12C shows the waveform of the level of a voltage across both terminals of each element (the waveform of the luminance level). Specifically, the element is applied across both terminals with a voltage $Ve_0$ when it is supplied with a driving current $I_0$ to emit light in a steady state. The reference value $V_{CC0}$ of the reverse bias voltage is set substantially equal to $Ve_0$.

During the $j^{th}$ scanning period, since the cathode lines $B_1$–$B_{j-1}$, $B_{j+1}$–$B_n$, not subjected to scanning, are applied with the reverse bias voltage $V_{CC0}$, the potential on the driven anode line A is set to approximately $V_{CC0}$ at the moment a transition has been made from the preceding reset period to the $j^{th}$ scanning period, and accordingly, the voltage across both ends of the element is also increased to $Ve_0$ ($=V_{CC0}$). Subsequently, since the element is continuously supplied with the driving current $I_0$, the voltage across both terminals of the element is maintained at $Ve_0$ over the $j^{th}$ scanning period. Thus, the luminance level of the element remains at a fixed level corresponding to $Ve_0$.

During the $(j+1)^{th}$ scanning period, since the cathode lines $B_1$–$B_j$, $B_{j+2}$–$B_n$, not subjected to scanning, are applied with the reverse bias voltage $V_{CCmax}$, the potential on the driven anode line A is set to approximately $V_{CCmax}$ at the moment a transition has been made from the preceding reset period to the $j+1^{th}$ scanning period, and accordingly, the voltage across both ends of the element is also increased to $Ve_{max}$. Subsequently, since the element is continuously supplied with the driving current $I_0$, the voltage across both terminals of the element decreases closer to $Ve_0$ as indicated by X in FIG. 12C. Since the luminance level of the element corresponds to a change in the voltage across both terminals of the element, the luminance is increased by the hatched area X in FIG. 12C as compared with the $j^{th}$ scanning period during which the reference value $V_{CC0}$ is applied as the reverse bias voltage.

During the $(j+2)^{th}$ scanning period, since the cathode lines $B_1$–$B_{j+1}$, $B_{j+3}$–$B_n$, not subjected to scanning, are applied with the reverse bias voltage $V_{CCmin}$, the potential on the driven anode line A is set to approximately $V_{CCmin}$ at the moment a transition has been made from the preceding reset period to the $(j+2)^{th}$ scanning period, and accordingly, the voltage across both ends of the element is also increased to $Ve_{min}$. Subsequently, since the element is continuously supplied with the driving current $I_0$, the voltage across both terminals of the element increases closer to $Ve_0$ as indicated by Y in FIG. 12C. Since the luminance level of the element corresponds to a change in the voltage across both terminals of the element, the luminance is reduced by the hatched area Y in FIG. 12C as compared with the $j^{th}$ scanning period where the reference value $V_{CC0}$ is applied as the reverse bias voltage.

According to this embodiment as explained above, when the luminance is adjusted in accordance with the pulse width modulation mode in the capacitive light-emitting element display device driven in accordance with the reset driving method, the reverse bias voltage applied to cathode lines, not subjected to scanning, is increased or decreased. It is therefore possible to extend a luminance adjusting range and accordingly realize a more practical capacitive light-emitting element display device as compared with prior art display devices in which a fixed reverse bias voltage is applied at all times.

FIGS. 13A to 13C show that the capacitive light-emitting panel driver is driven by the pulse level modulation mode, wherein three consecutive elements connected to an anode line Ax are sequentially driven to emit light at a standard luminance during a $j^{th}$ scanning period; at a maximum luminance during a $j+1^{th}$ scanning period; and at a minimum luminance during a $(j+2)^{th}$ scanning period. As can be seen, the aforementioned reset period exists between respective scanning periods. FIG. 13A shows the waveform of a driving current. The elements are applied with driving current pulses which have a fixed current width and a varying level corresponding to the luminance during the $j^{th}$, $j+1^{th}$, and $(j+2)^{th}$ scanning periods. Specifically, as shown in the waveform chart, the driving current has a current level with a maximum value $I_{max}$ for a maximum luminance; a reference value $I_0$ for a standard luminance; and a minimum value $I_{min}$ for a minimum luminance. FIG. 13B shows the waveform of a reverse bias voltage level applied to cathode lines B other than that to be scanned. The cathode lines B are applied with a reverse bias voltage level corresponding to the luminance in each scanning period, and specifically applied with a maximum value $V_{CCmax}$ for the maximum luminance; a reference value $V_{CC0}$ for the standard luminance; and a minimum value $V_{CCmin}$ for the minimum luminance.

FIG. 13C shows the waveform of the level of a voltage across both terminals of each element (the waveform of the luminance level). As is the case of FIGS. 12A to 12C, the element is applied across both terminals thereof with a voltage $Ve_0$ ($=V_{CC0}$) when it is supplied with a driving current $I_0$ to emit light in a steady state. Also, the element is applied across both terminals with a voltage $Ve_{max}$ when it is supplied with a driving current $I_{max}$ to emit light in a steady state, and with a voltage $Ve_{min}$ when it is supplied with a driving current $I_{min}$ to emit light in a steady state. Stated another way, the light emission regulating voltage varies in response to the driving current level. Also, the reverse bias voltage level $V_{CCmax}$ is set substantially equal to $Ve_{max}$, and $V_{CCmin}$ is set substantially equal to $Ve_{min}$.

During the $j^{th}$ scanning period, since the driving current is $I_0$ and the cathode lines $B_1$–$B_{j-1}$, $B_{j+1}$–$B_n$, not subjected to scanning, are applied with the reverse bias voltage $V_{CC0}$, the potential on the driven anode line A is set to approximately $V_{CC0}$ at the moment a transition has been made from the preceding reset period to the $j^{th}$ scanning period, and accordingly, the voltage across both ends of the element is also increased to $Ve_0$ ($=V_{CC0}$). Subsequently, since the element is continuously supplied with the driving current $I_0$, the voltage across both terminals of the element is maintained at $Ve_0$ over the $j^{th}$ scanning period. Thus, the luminance level of the element remains at a fixed level corresponding to $Ve_0$ during the $j^{th}$ scanning period.

During the $(j+1)^{th}$ scanning period, while the driving current is increased to $I_{max}$, the reverse bias voltage applied to the cathode lines $B_1$–$B_j$, $B_{j+2}$–$B_n$, not subjected to scanning, is also increased to $V_{CCmax}$. Thus, the potential on the driven anode line A is set to approximately $V_{CCmax}$ at the moment a transition has been made from the preceding reset period to the $j+1^{th}$ scanning period, and accordingly, the voltage across both ends of the element is also increased to $Ve_{max}$. Subsequently, since the element is continuously supplied with the driving current $I_{max}$, the voltage across both terminals of the element is maintained at $Ve_{max}$ over the entire $(j+1)^{th}$ scanning period. Thus, the luminance level of the element can be maintained at a fixed level corresponding to $Ve_{max}$.

During the $(j+2)^{th}$ scanning period, while the driving current is decreased to $I_{min}$, the reverse bias voltage applied to the cathode lines $B_1$–$B_{j+1}$, $B_{j+3}$–$B_n$, not subjected to scanning, is also decreased to $V_{CCmin}$. Thus, the potential on the driven anode line A is set to approximately $V_{CCmin}$ at the moment a transition has been made from the preceding reset period to the $(j+2)^{th}$ scanning period, and accordingly, the voltage across both ends of the element is also decreased to $Ve_{min}$. Subsequently, since the element is continuously supplied with the driving current $I_{min}$, the voltage across both terminals of the element is maintained at $Ve_{min}$ over the entire $(j+2)^{th}$ scanning period. Thus, the luminance level of the element can be maintained at a fixed level corresponding to $Ve_{min}$ over the $(j+2)^{th}$ scanning period.

Thus, the luminance can be maintained at a fixed level corresponding to the reverse bias voltage level applied to the cathode lines.

According to this embodiment as explained above, when the luminance is adjusted in accordance with the pulse level modulation mode in the capacitive light-emitting element display device driven in accordance with the reset driving method, the reverse bias voltage applied to cathode lines, not subjected to scanning, is increased or decreased corresponding to the varying pulse level. It is therefore possible to constantly maintain the luminance level closer to a fixed level during a scanning period and accordingly realize a capacitive light-emitting display device excellent in the linearity of gradation, as compared with prior art display devices in which a fixed reverse bias voltage is applied at all times.

This embodiment has shown that the reverse bias voltage $V_{CCmax}$ for the maximum luminance is set substantially equal to $Ve_{max}$, and the reverse bias voltage $V_{CCmin}$ for the minimum luminance is set substantially equal to $Ve_{min}$, to accomplish the most accurate linearity of gradation. The present invention, however, is not limited to this particular settings of the reverse bias voltage. Alternatively, the linearity of gradation can be improved only by increasing or decreasing the level of the reverse bias voltage corresponding to the varying pulse level of the driving current, as compared with prior art display devices in which a fixed reverse bias voltage is applied at all times.

Figures 14A, 14B:
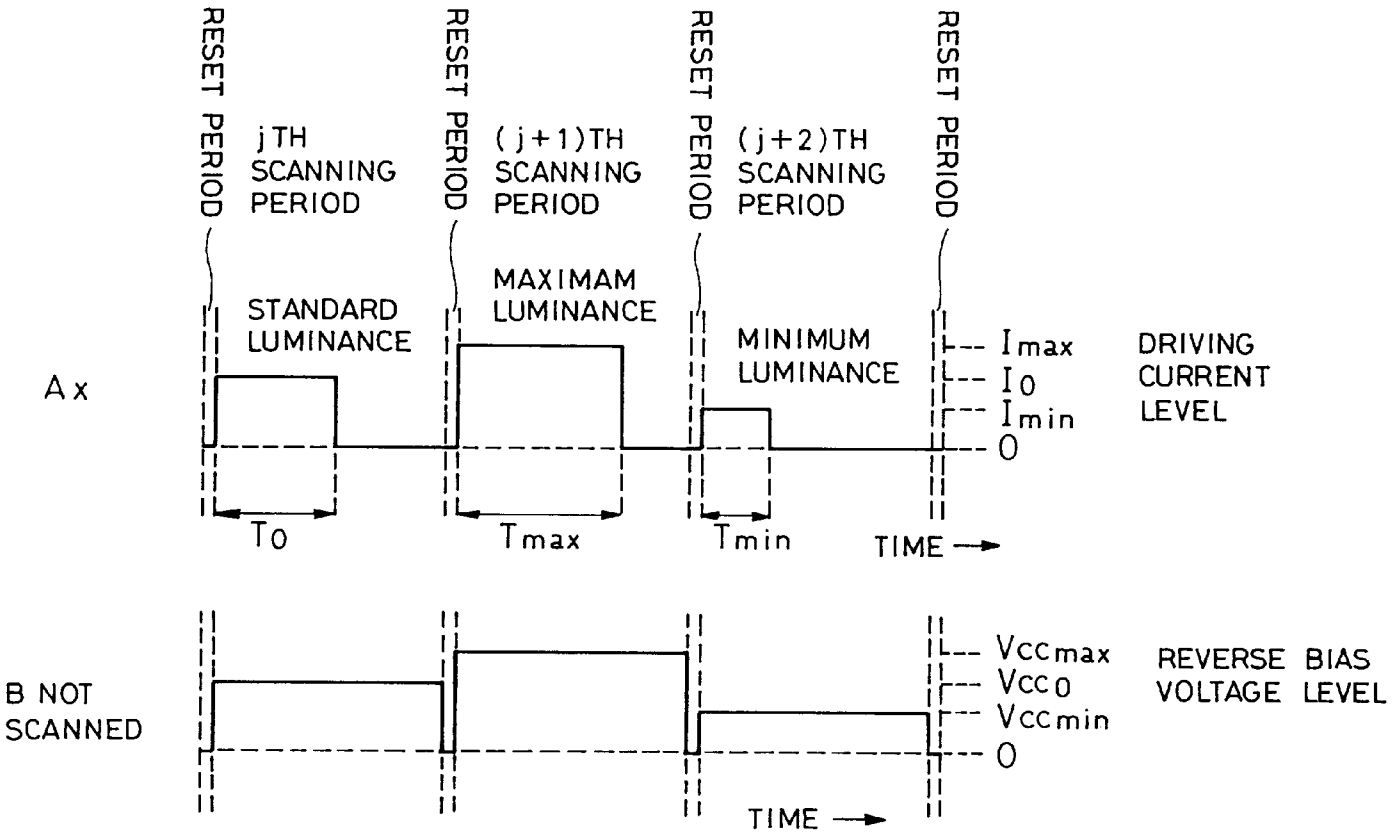
FIGS. 14A and 14B are timing charts showing a further aspect of the reset driving method for a display device according to the present invention.

FIGS. 14A and 14B show another embodiment which uses a combination of the foregoing pulse width modulation mode and pulse level modulation mode to represent luminance gradation. As shown, when the element is driven to emit light at a maximum luminance, a driving current level is set to $I_{max}$, and a pulse width is set to $T_{max}$. Conversely, when the element is driven to emit light at a minimum luminance, the driving current level is set to $I_{min}$, and the pulse width is set to $T_{min}$. According to this embodiment, since both the current level and the pulse width are made adjustable, finer gradation changes can be reproduced than when either the pulse width modulation mode or the pulse level modulation mode is only applied, thereby making it possible to provide gradation representations with a larger number of gradation levels.

It should be noted that in this embodiment, the control means 45 relies on the luminance data to determine two types of modulations for the current level and the pulse width, a table-based control is preferably conducted such that a current level and a pulse width can be uniquely lead out in accordance with particular luminance data.

While several preferred embodiments of the present invention have been explained, the present invention is not limited to the specific embodiments disclosed above.

First, while the foregoing embodiments have been explained in connection only with the reset driving method that is employed to drive the capacitive light-emitting element display device, the present invention may also be applied to the conventional simple matrix driving method which does not include reset periods.

Furthermore, the reverse bias potential level may be set by the reverse bias adjusting circuit 30 at any appropriate timing other than those described with reference to the preferred embodiment, in accordance with the signal from the control circuit 45.

Figure 7A:
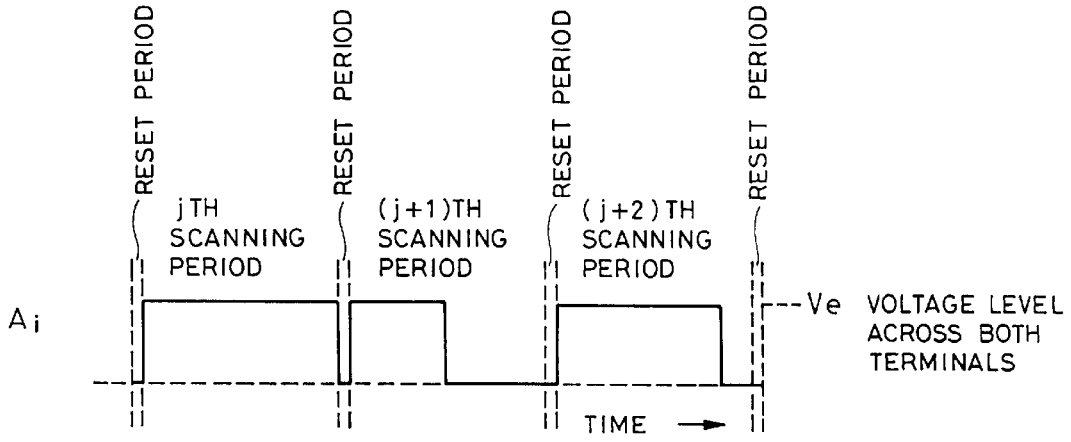
FIGS. 7A and 7B are timing charts for explaining how the luminance is adjusted in a conventional display device using organic electroluminescence elements.
Figure 7B:
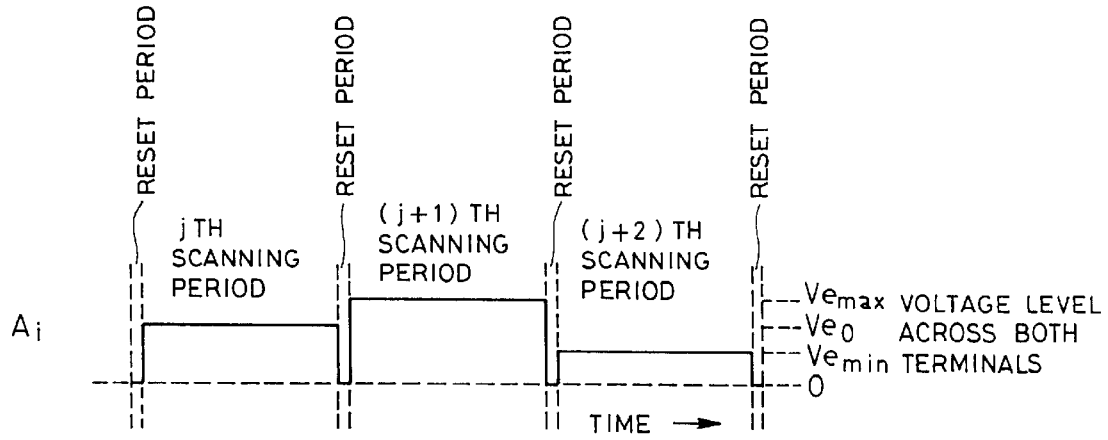
Figure 8:
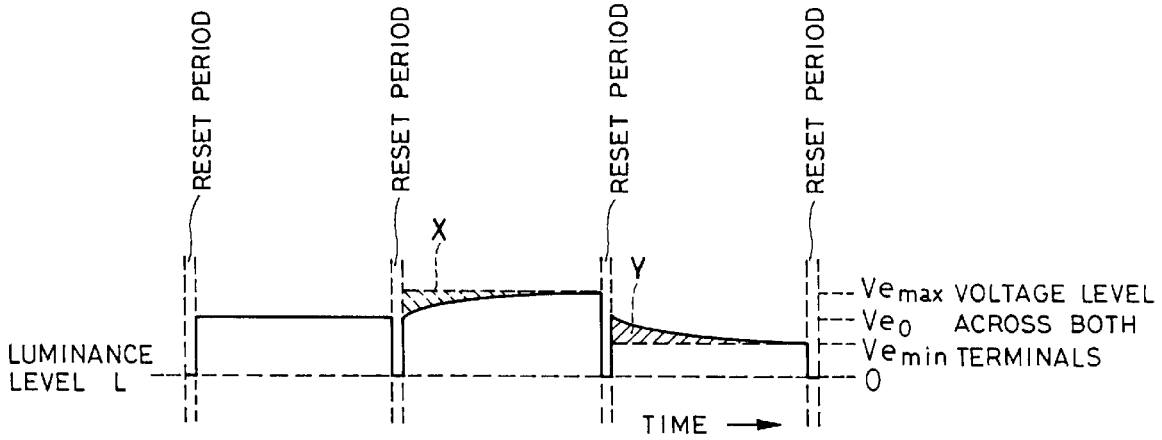
FIG. 8 is a timing chart showing problems of luminance adjustment in the conventional display device using organic electroluminescence elements.

As described above, the conventional simple matrix driving method, if employed, would require an extra time from the start of a scanning period to a steady light emitting state due to a charge of opposite polarity stored in the element. In this event, if the luminance is adjusted in accordance with the pulse level modulation mode previously shown in FIG. 7B, the light emission regulating voltage, which changes in accordance with luminance gradation during the steady light emission state, will cause variations in the time from the start of a scanning period to a steady light emitting state, thereby resulting in a degraded linearity of gradation. However, if the reverse bias voltage is increased corresponding to a varying pulse level, as shown in FIG. 13, this will reduce the variations in time from the start of a scanning period to a steady light emitting state, thus making it possible to accomplish a satisfactorily accurate linearity of gradation.

Also, while in the foregoing embodiments, the anode lines A and the cathode lines B are connected to the ground potential during a reset period, the anode lines A and the cathode lines B may be connected to substantially the same potential, not limited to the ground potential. In addition, some potential difference between the anode lines A and the cathode lines B may be tolerated provided that the potential difference falls within a range in which a voltage across both terminals of the element does not exceed a light emission threshold voltage, and can reduce the charge of opposite polarity.

As described above in detail, the capacitive light-emitting element display device according to the present invention has a plurality of capacitive light-emitting elements arranged at a plurality of intersections of drive lines and scanning lines and connected between the scanning lines and the drive lines, and is driven in such a manner that the scanning lines are connected to one of different first and second potentials, the drive lines are connected to either the lower potential of the first and second potentials or a driving source, and, in synchronism with a scanning period in which selected one of the scanning lines is connected to the lower potential of the first and second potentials, selected one of the drive lines is connected to the drive source to force a capacitive light-emitting element associated therewith to emit light, and simultaneously the scanning lines, not selected, are connected to the lower potential of the first and second potentials, wherein the higher potential of the first and second potentials is made adjustable. It is therefore possible to provide a capacitive light emitting display device which has excellent effects such as an extended luminance adjustable range for the panel, an improved linearity of gradation, and so on.

What is claimed is:

1. A method of driving a capacitive light-emitting element display device having a plurality of capacitive light-emitting elements arranged at a plurality of intersections of drive lines and scanning lines and connected between said scanning lines and said drive lines, said method comprising the steps of:

connecting said scanning lines to either first or second potential, said first and second potential being different from each other;

connecting said drive lines to either a higher potential of said first and second potentials or a drive source; and in synchronism with a scanning period in which selected one of said scanning lines is connected to the lower potential of said first and second potentials, connecting selected one of said drive lines to said drive source to force a capacitive light-emitting element associated therewith to emit light, and simultaneously connecting said scanning lines, not selected, to the lower potential of said first and second potentials, wherein the higher potential of said first and second potentials is made adjustable.

2. A driving method according to claim 1, further comprising the step of resetting all said capacitive light-emitting elements during a reset period between said scanning periods.

3. A driving method according to claim 2, wherein the higher potential of said first and second potentials is made adjustable from one field period to another, and is maintained at a fixed potential during each field period.

4. A driving method according to claim 3, wherein said drive source is a regulated current source.

5. A driving method according to claim 4, wherein the higher potential of said first and second potentials is adjusted within a range higher than a potential derived by subtracting a light emission threshold voltage from a light emission regulating voltage of said capacitive light-emitting element, and a lower potential of said first and second potentials is a ground potential.

6. A driving method according to claim 3, wherein said drive source is a variable current source.

7. A driving method according to claim 2, wherein said drive source is a regulated current source.

8. A driving method according to claim 7, wherein the higher potential of said first and second potentials is adjusted within a range higher than a potential derived from subtracting a light emission threshold voltage from a light emission regulating voltage of said capacitive light-emitting element, and a lower potential of said first and second potentials is a ground potential.

9. A driving method according to claim 2, wherein said drive source is a variable current source.

10. A driving method according to claim 2, wherein during said reset period, said drive lines and said scanning lines are set at the same potential.

11. A driving method according to claim 1, wherein the higher potential of said first and second potentials is made adjustable from one field period to another, and is maintained at a fixed potential during each field period.

12. A driving method according to claim 11, wherein said drive source is a regulated current source.

13. A driving method according to claim 12, wherein the higher potential of said first and second potentials is adjusted within a range higher than a potential derived from subtracting a light emission threshold voltage from a light emission regulating voltage of said capacitive light-emitting element, and a lower potential of said first and second potentials is a ground potential.

14. A driving method according to claim 11, wherein said drive source is a variable current source.

15. A driving method according to claim 1, wherein said drive source is a regulated current source.

16. A driving method according to claim 15, wherein the higher potential of said first and second potentials is adjusted within a range higher than a potential derived from subtracting a light emission threshold voltage from a light emission regulating voltage of said element, and a lower potential of said first and second potentials is a ground potential.

17. A driving method according to claim 1, wherein said drive source is a variable current source.

18. A driving method according to claim 1, wherein the higher potential of said first and second potentials is adjusted to be substantially equal to the light emission regulating voltage of said capacitive light emitting elements, and a lower potential of said first and second potentials is a ground potential.

19. A driving method according to claim 1, wherein during said scanning period, the remaining drive lines except for said selected drive line connected to said drive source are connected to the lower one of said first and second potentials.

20. A driving method according to claim 1, wherein said capacitive light-emitting elements are organic electroluminescence elements.

21. A capacitive light-emitting element display device comprising:

a plurality of capacitive light-emitting elements arranged at a plurality of intersections of drive lines and scanning lines and connected between said scanning lines and said drive lines;

scanning switch means for connecting said scanning lines to either first or second potential, said first and second potentials being different from each other;

drive switch means for connecting said drive lines to a higher potential of said first and second potentials or a drive source;

light emission control means for controlling said drive switch means and said scanning means, said light emission control means, operative in synchronism with a scanning period in which said scanning switch means connects selected one of said scanning lines to the higher potential of said first and second potentials, for controlling said drive switch means to selectively connect said drive lines to said drive source to force selected capacitive light-emitting elements to emit light, and simultaneously controlling said scanning switch means to connect said scanning lines, not selected, to a lower potential of said first and second potentials; and adjusting means for adjusting the higher potential of said first and second potentials.

22. A capacitive light-emitting element display device according to claim 21, wherein said light emission control means defines a period between said scanning periods for resetting all said capacitive light-emitting elements are reset.

23. A capacitive light-emitting element display device according to claim 22, wherein said adjusting means adjusts the higher potential of said first and second potentials from one field period to another, and maintains said higher potential at a fixed potential during each field period.

24. A capacitive light-emitting element display device to claim 23, wherein said drive source is a regulated current source.

25. A capacitive light-emitting element display device according to claim 24, wherein said adjusting means adjusts the higher potential of said first and second potentials within a range higher than a potential derived by subtracting a light emission threshold voltage from a light emission regulating voltage of said element, and the lower potential of said first and second potentials is a ground potential.

26. A capacitive light-emitting element display device according to claim 23, wherein said drive source is a variable current source.

27. A capacitive light-emitting element display device to claim 22, wherein said drive source is a regulated current source.

28. A capacitive light-emitting element display device according to claim 27, wherein said adjusting means adjusts the higher potential of said first and second potentials within a range higher than a potential derived by subtracting a light emission threshold voltage from a light emission regulating voltage of said element, and the lower potential of said first and second potentials is a ground potential.

29. A capacitive light-emitting element display device according to claim 22, wherein said drive source is a variable current source.

30. A capacitive light-emitting element display device according to claim 22, wherein said light emission control means sets said drive lines and said scanning lines at the same potential during said reset period.

31. A capacitive light-emitting element display device according to claim 21, wherein said adjusting means adjusts the higher potential of said first and second potentials from one field period to another, and maintains said higher potential at a fixed potential during each field period.

32. A capacitive light-emitting element display device to claim 31, wherein said drive source is a regulated current source.

33. A capacitive light-emitting element display device according to claim 32, wherein said adjusting means adjusts the higher potential of said first and second potentials within a range higher than a potential derived by subtracting a light emission threshold voltage from a light emission regulating voltage of said element, and the lower potential of said first and second potentials is a ground potential.

34. A capacitive light-emitting element display device according to claim 31, wherein said drive source is a variable current source.

35. A capacitive light-emitting element display device to claim 21, wherein said drive source is a regulated current source.

36. A capacitive light-emitting element display device according to claim 35, wherein said adjusting means adjusts the higher potential of said first and second potentials within a range higher than a potential derived by subtracting a light emission threshold voltage from a light emission regulating voltage of said element, and the lower potential of said first and second potentials is a ground potential.

37. A capacitive light-emitting element display device according to claim 21, wherein said drive source is a variable current source.

38. A capacitive light-emitting element display device according to claim 21, wherein said adjusting means adjusts the higher potential of said first and second potentials to be substantially equal to the light emission regulating voltage of said light emitting element, and the lower potential of said first and second potentials is a ground potential.

39. A capacitive light-emitting element display device according to claim 21, wherein said light emission control means connects the remaining drive lines except for said selected drive line connected to said drive source to the lower one of said first and second potentials during said scanning period.

40. A capacitive light-emitting element display device according to claim 21, wherein said capacitive light-emitting elements are organic electroluminescence elements.

* * * * *

UNITED STATES PATENT AND TRADEMARK OFFICE

CERTIFICATE OF CORRECTION

PATENT NO. : 6,587,087 B1
DATED : July 1, 2003
INVENTOR(S) : Shinichi Ishizuka

It is certified that error appears in the above-identified patent and that said Letters Patent is hereby corrected as shown below:

Column 17,
Line 33, should read -- one of said scanning lines is connected to a lower --
Line 38, should read -- said scanning lines, not selected, to the higher potential --

Column 18,
Lines 63-64, should read -- connects selected one of said scanning lines to a lower potential of said first and second potentials, for --

Column 19,
Line 3, should read -- to the higher potential of said first and second --

Signed and Sealed this

Third Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,587,087 B1
DATED : July 1, 2003
INVENTOR(S) : Shinichi Ishizuka

It is certified that error appears in the above-identified patent and that said Letters Patent is hereby corrected as shown below:

Column 17,
Line 30, delete “higher” and replace with -- lower --.
Line 33, delete “a” and replace with -- the --.

Column 18,
Line 57, delete “higher” and replace with -- lower --.
Line 63, delete “a” and replace with -- the --.

Signed and Sealed this

Twentieth Day of September, 2005

JON W. DUDAS
*Director of the United States Patent and Trademark Office*